US007826220B1

(12) United States Patent
Baker

(10) Patent No.: US 7,826,220 B1
(45) Date of Patent: Nov. 2, 2010

(54) ELECTRONIC DEVICE SECURITY CONTAINER

(76) Inventor: Aaron M. Baker, 4456 Treasure Valley, Claremont, CA (US) 91711

( * ) Notice: Subject to any disclaimer, the term of this patent is extended or adjusted under 35 U.S.C. 154(b) by 264 days.

(21) Appl. No.: 12/156,474

(22) Filed: Jun. 2, 2008

(51) Int. Cl.
*H05K 5/00* (2006.01)

(52) U.S. Cl. ..... 361/679.57; 361/679.4; 361/679.41; 381/386; 109/73; 340/5.2

(58) Field of Classification Search ..... 361/679.01, 361/679.33, 679.4, 679.41, 679.56, 824
See application file for complete search history.

(56) References Cited

U.S. PATENT DOCUMENTS

| | | | | |
|---|---|---|---|---|
| 4,542,848 | A | 9/1985 | Peters | |
| 4,768,021 | A | 8/1988 | Ferraro | |
| 4,800,822 | A | 1/1989 | Adkins | |
| 5,111,755 | A | 5/1992 | Rouse | |
| 5,416,826 | A | 5/1995 | Butler | |
| 5,701,770 | A | 12/1997 | Cook et al. | |
| 6,488,148 | B1 | 12/2002 | Woodson | |
| 7,178,370 | B2 | 2/2007 | Engel | |
| 7,350,470 | B1 * | 4/2008 | Stuhlbarg et al. | 109/73 |
| 7,661,584 | B1 * | 2/2010 | Lute et al. | 235/379 |
| 2005/0135053 | A1 * | 6/2005 | Carroll | 361/683 |
| 2006/0112741 | A1 * | 6/2006 | Engel | 70/63 |
| 2007/0036384 | A1 * | 2/2007 | Struthers et al. | 381/386 |
| 2007/0147013 | A1 * | 6/2007 | Robbins et al. | 361/759 |
| 2008/0150684 | A1 * | 6/2008 | Gartner | 340/5.53 |
| 2008/0310093 | A1 * | 12/2008 | McEwan et al. | 361/683 |
| 2009/0175458 | A1 * | 7/2009 | Smith | 381/28 |

* cited by examiner

*Primary Examiner*—Jayprakash N Gandhi
*Assistant Examiner*—Courtney Smith
(74) *Attorney, Agent, or Firm*—Gordon K. Anderson

(57) ABSTRACT

An electronic device security container is taught which is used for storing valuable objects which consists of a console having electronic devices inside including a clock radio, a iPod® docking station, a fingerprint recognition biometric device and an electrical locking mechanism. A power supply provides electrical energy to the electronic devices housed within the console. An enclosure is attached to the console, which has a top opening lid, and a bottom storage container with a spring loaded hinge attached therebetween. An alternate embodiment is for a slide drawer opening security container differing only in the configuration of an enclosure which contains a sliding drawer under the console instead of the lid opening on the enclosure top.

17 Claims, 7 Drawing Sheets

ELECTRONIC DEVICE SECURITY CONTAINER

TECHNICAL FIELD

The present invention relates to security container in general. More specifically to a container having electronic devices including a digital clock radio and an iPod® docking station in a secure container large enough to contain valuable items particularly a handgun.

BACKGROUND OF THE INVENTION

Previously, many types of security safes have been used in endeavoring to provide an effective means to protect valuable items such as a firearm and have readily available access at times requiring immediate protection.

The prior art listed below did not disclose patents that possess any of the novelty of the instant invention; however the following U.S. patents are considered related:

| U.S. Pat. No. | Inventor | Issue Date |
|---|---|---|
| 4,542,848 | Peters | Sep. 24, 1985 |
| 4,768,021 | Ferraro | Aug. 30, 1988 |
| 4,800,822 | Adkins | Jan. 31, 1989 |
| 5,111,755 | Rouse | May 12, 1992 |
| 5,416,826 | Butler | May 16, 1995 |
| 5,701,770 | Cook et al. | Dec. 30, 1997 |
| 6,488,148 B1 | Woodson | Dec. 3, 2002 |
| 7,178,370 B2 | Engel | Feb. 20, 2007 |

Peters in U.S. Pat. No. 4,542,848 teaches a strong box locked by rotating a threaded arm into a thread engaging member within the box. The threaded arm is released by a key which has access to the locking mechanism from outside the box.

Adkins in U.S. Pat. No. 4,800,822 discloses a gun safe having an ejectable drawer with a hinged door connected to the open end of a housing. The drawer is reciprocatingly mounted within the housing and is spring loaded to bear against the closed door such that upon opening the door the ejectable drawer is forced outwardly to present the firearm contained therein for easy grasping.

Butler in U.S. Pat. No. 5,416,826 teaches an electronically operated gun safe which has a telephone system with interactive contact with law enforcement with an emergency key word when the safe is opened. The system provides an alarm when the phone line is removed without the key word.

U.S. Pat. No. 5,701,770 issued to Cook et al. a gun safe having a dual method of gaining access therein. The gun safe has a portable housing with a hinged door on one end with a solenoidal locking mechanism adjacent to the door. A fingerprint scanning mechanism supplies a signal to unlock the locking mechanism when a scanned fingerprint matches one stored in memory.

U.S. Pat. No. 6,488,148 B1 of Woodson is for a gun securing and storage device which includes a case having a base and a bottom panel with peripheral walls extending upwardly therefrom. A plurality of aligned holes extend through the inner wall into a chamber having the locking means. Trigger guard members align with the trigger guard of the handgun.

Engel in U.S. Pat. No. 7,178,370 B2 discloses a safe with a computer system which permits a loaded firearm to be safely stored inside. The door safe opens silently and uses motive power provided by gravity. Biometric data sorted in the memory of the computer system opens the safe.

For background purposes and as indicative of the art to which the invention is related reference may be made to the remaining cited patents issued to Rouse in U.S. Pat. No. 5,111,755 and Ferraro in U.S. Pat. No. 4,768,021.

BRIEF SUMMARY OF THE INVENTION

In the past there have been many safes, strong boxes and enclosures invented and on the market to protect valuable articles particularly handguns to assure safety along with quick and easy removal when needed. In order to accommodate these requirements many and varied locking apparatus have been used. In most cases the prior art boxes and containers usually have the outward appearance of a safe used for the specific purpose of housing a firearm.

It is therefore the primary object of the invention to provide a container that has other uses and does not resemble a gun safe but may be placed in plain sight an not draw attention to its primary utility. To complete the deception the invention uses a clock radio in combination with an iPod® docking station mounted within the front and top of the container enclosure and have an exposed speaker covering.

An important object of the invention is that the clock radio and iPod® docking station are completely functional and the docking station actually utilizes the radio speakers for its audio output which may be intuitively obvious to a knowledgeable observer.

Another object of the invention is that a fingerprint recognition biometric device is used to open the enclosure by simply placing ones finger on the optical sensor which is installed on the top of the enclosure directly behind the iPod® cradle. To misguide the unfamiliar, the fingerprint recognition biometric device must be actuated by pressing an on-button located adjacent to the iPod® cradle. For the authorized individual a green LED is located near the button, which when energized indicates readiness to accept a fingerprint.

Still another object of the invention is that the lid or drawer of the invention is spring loaded to partially open, in a quiet manner, when the user's fingerprint minutia features are matched with its digital image biometric template.

Yet another object of the invention is the even though the fundamental purpose of the invention is to house a pistol or revolver any other valuable articles such as jewelry or documents may be easily stored.

A further object is that two embodiments are taught in the invention with the first a top opening lid with a thin modern outline and second a larger slide drawer embodiment with a separate drawer underneath a switch gear console which includes the clock radio and the docking station. The second embodiment provides a larger storage area which is particularly useful for documents and bulky valuables.

Another object of the invention is that a power supply, for the clock radio, iPod® docking station and fingerprint recognition biometric device, may be furnished using different sources and techniques. A remote AC/DC power converter, an internal AC/DC power converter with a mains power cord or storage batteries are all viable alternatives. A jack would be provided in the console for the remote power converter, or if the power converter were incorporated within the container, a conventional power cord would extend from the container at a suitable location. Batteries are easily located within the container and access would be provided for battery access.

A final object of the invention is the inclusion of bypass entry means for circumventing the fingerprint recognition biometric device. A key lock electric bypass may be used with a high security circular keyway lock mounted within the console requiring a mating circular key to energize an electrical locking mechanism for gaining access into the container. A conventional USB port may be mounted into the console and attached to its own electronic system sending a signal from a remote electronic device such as a computer or other electronic device to energize the electrical locking mechanism thereby gaining access into the security container.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
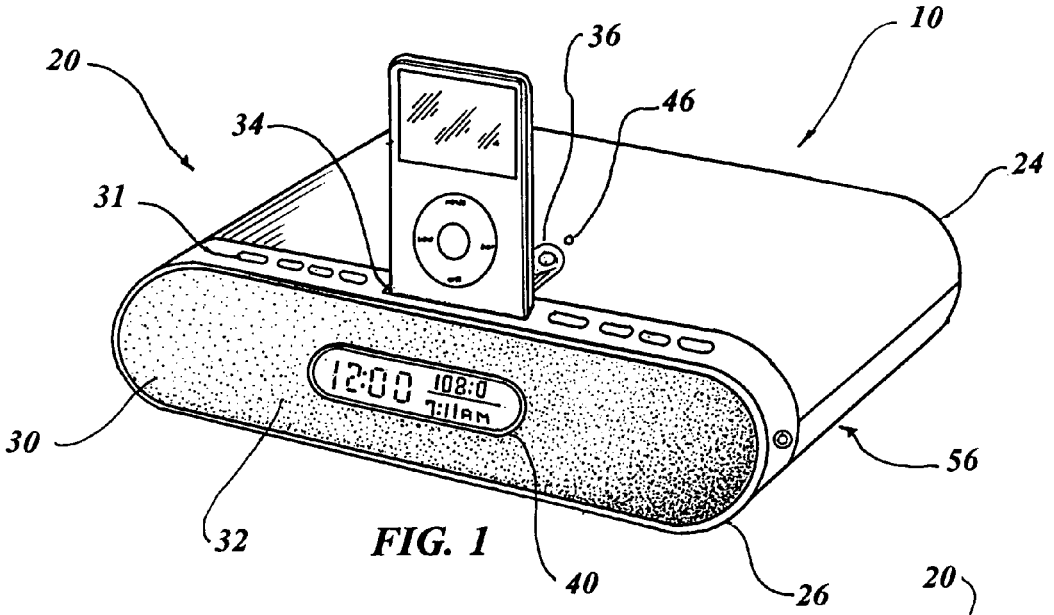
FIG. 1 is a partial isometric view of the invention with an iPod® mounted in the docking station cradle, in the top opening lid embodiment.
Figure 9:
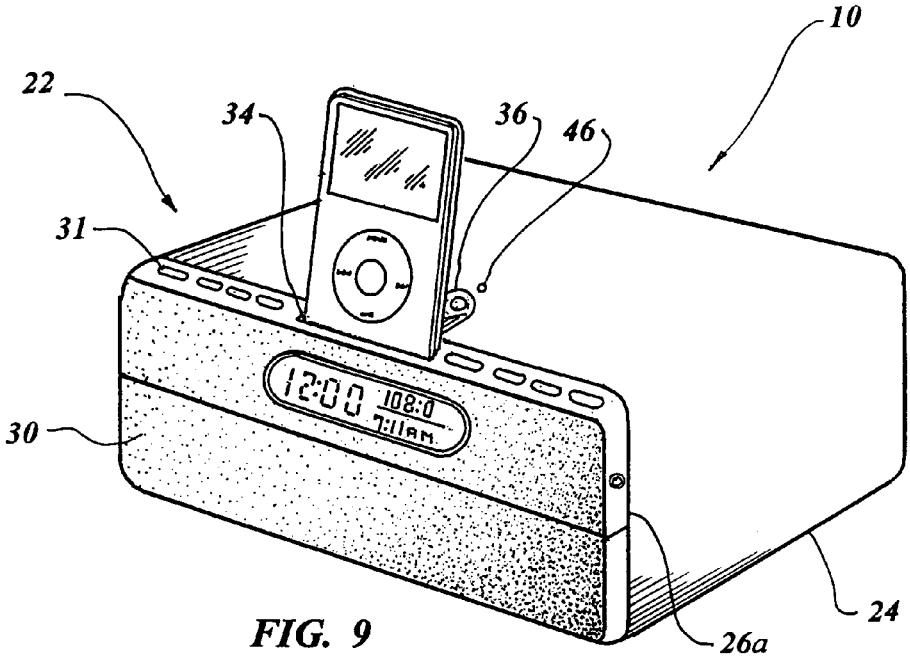
FIG. 9 is a partial isometric view of the invention with an iPod® mounted in the docking station cradle, in the slide drawer opening lid embodiment.

The best mode for carrying out the invention of the electronic device security container 10 is presented in terms of a top opening lid embodiment 20, shown in FIGS. 1 thorough 8 and 17, and a slide drawer opening embodiment 22, illustrated in FIGS. 9 thorough 16 and 17.

Figure 8:
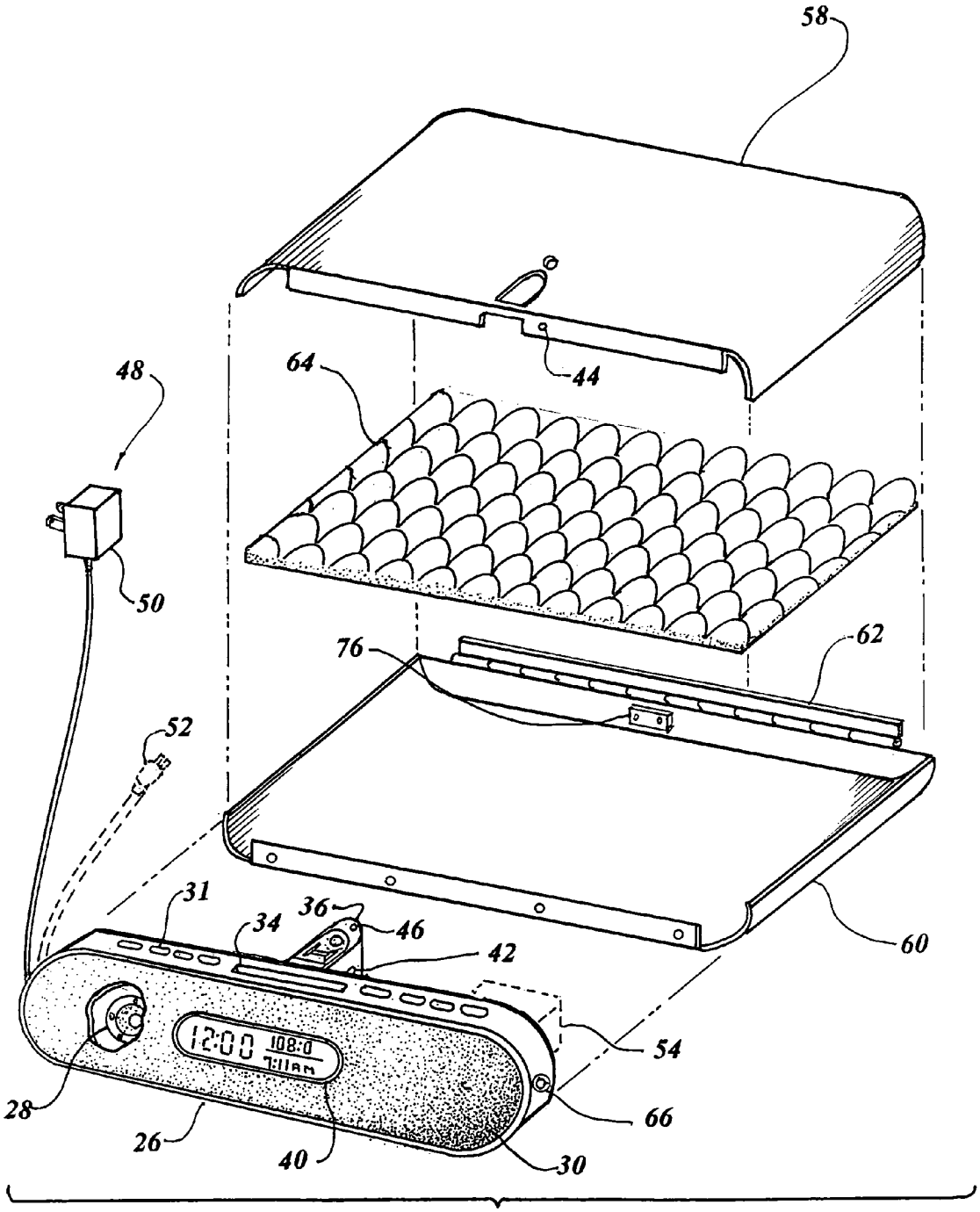
FIG. 8 is an exploded view partial isometric view of the invention in the top opening lid embodiment.
Figure 16:
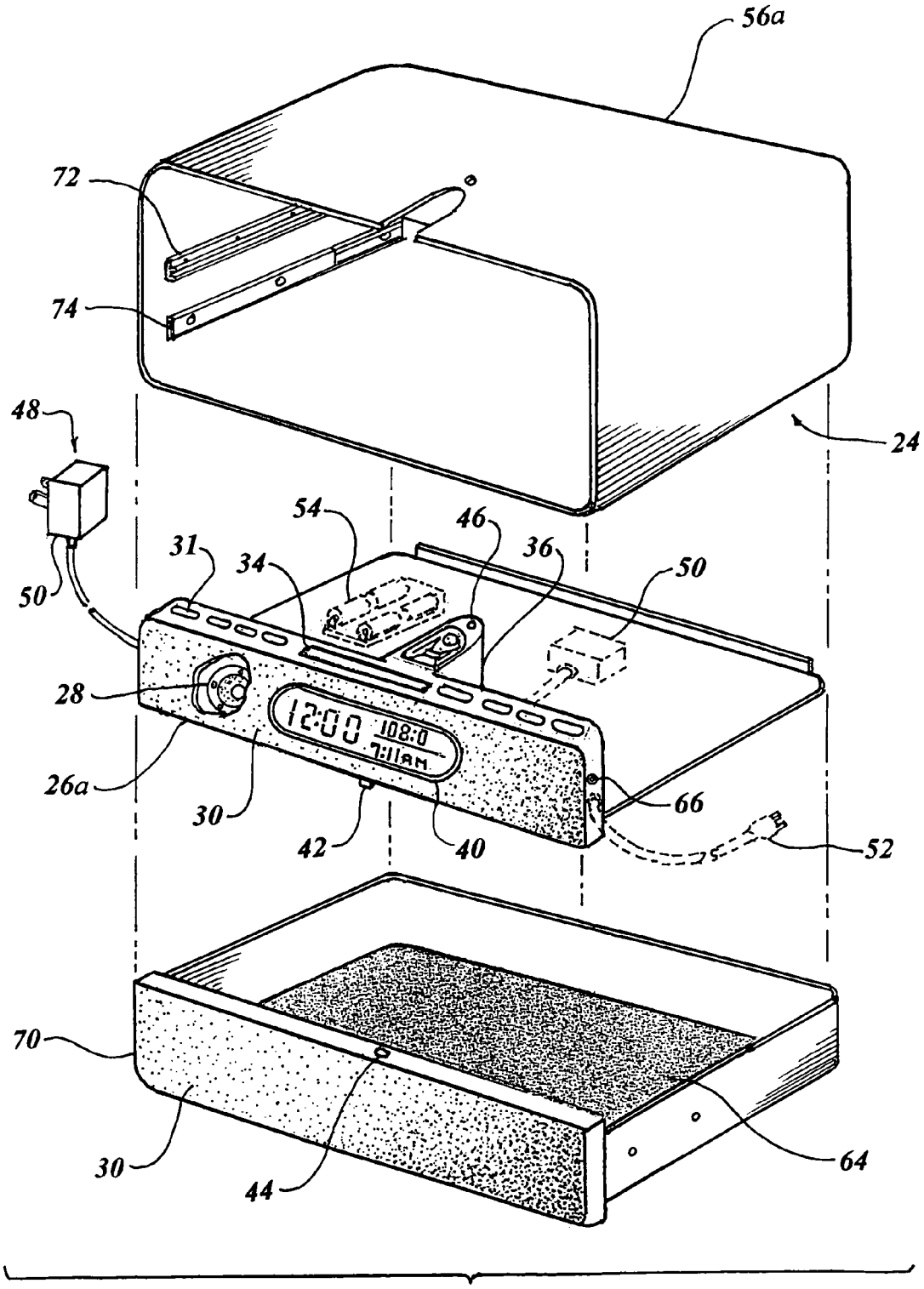
FIG. 16 is an exploded partial isometric view of the invention in the slide drawer embodiment.

The top opening lid embodiment 20 is comprised of an electronic device security container 24 for storing valuable objects that includes a console 26 utilizing a number of electronic devices. The console 26 incorporates at least two separate audio speakers 28 facing the outside surface of the console 26, as illustrated in FIGS. 8 and 16, allowing sound to be emitted into the surrounding environment. The console 26 also includes a speaker acoustic covering 30 mounted in front of the speakers 28. The covering 30 is made from a material such as perforated metal, perforated thermoplastic resin, wire cloth, wire fabric, synthetic screening fiberglass cloth, woven material, flannel cloth and the like.

The electronic devices within the console 26 consist of a clock radio 32, an iPod® docking station 34, a fingerprint recognition biometric device 36 and an electrical locking mechanism 38 for gaining access into the security container 24.

Figure 17:
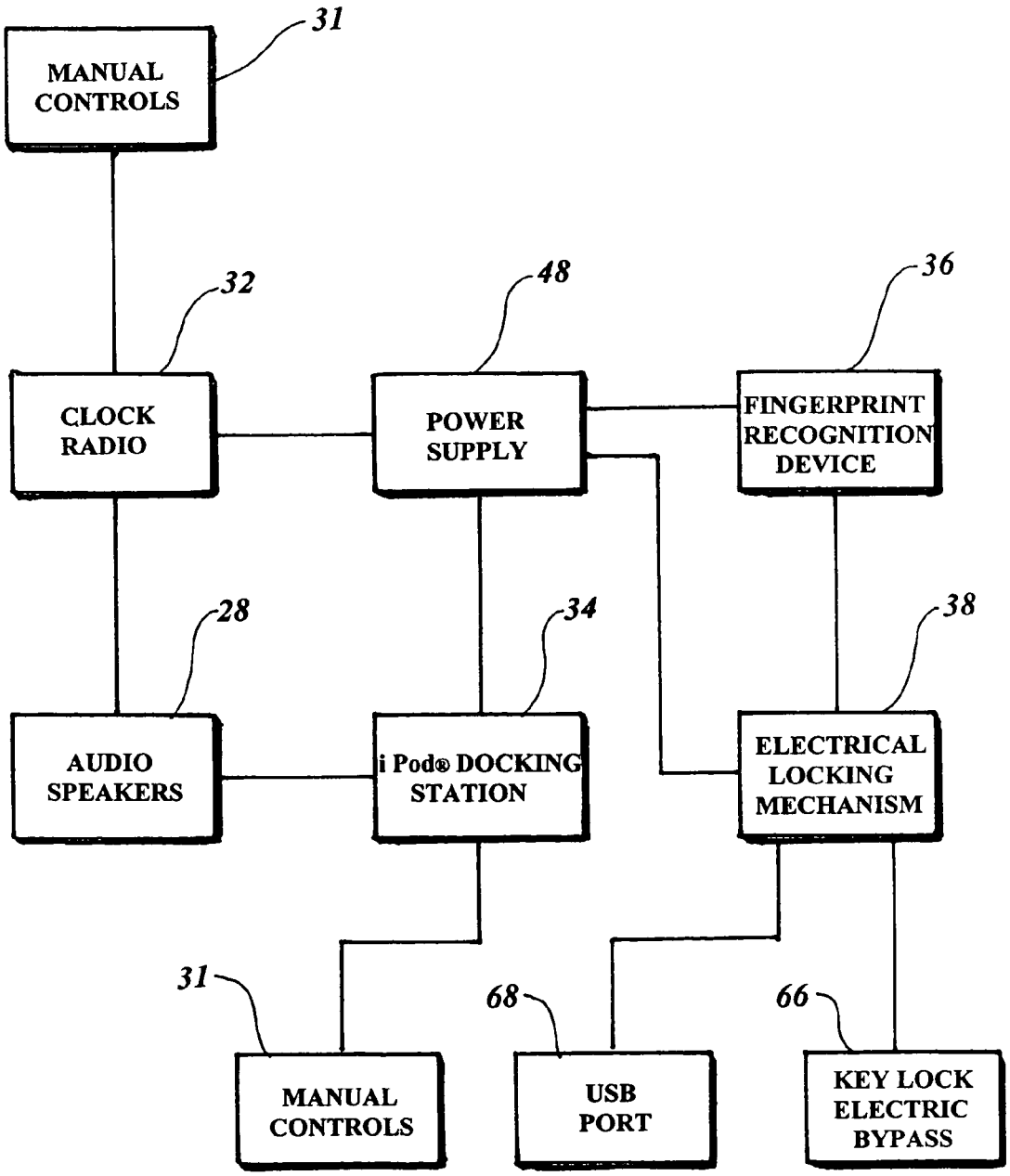
FIG. 17 is a block diagram of the electronics for both the top opening and slide drawer embodiments.

The clock radio 32 utilizes a digital clock time display 40 along with a conventional AM/FM radio having a built in antenna. The iPod® docking station 34 is a self contained unit that includes a cradle, a USB port, a firewire port and a stereo jack for attachment to the speakers 28. The ports may be optionally extended to an outside surface of the console 26 as a factory accessory. The fingerprint recognition biometric device 36 creates a digital image of a fingerprint pattern with a biometric template which matches a user's template stored therein. The fingerprint recognition biometric device 36 protrudes from the back portion of the console 26 with the operating components accessible from the top of the container 24. The electrical locking mechanism 38 is preferably an electrical solenoid 42 attached mechanically to a latch 44 in the container 24. The interrelation of each electronic device is illustrated in the block diagram of FIG. 17.

The console 26 further contains manual controls 31 for regulating the electronic devices which include the following: time and date setting means for the clock portion of the clock radio 32 and on/off setting; AM/FM setting; station selection and audio volume for the radio portion of the clock radio 32; on/off setting and audio volume control for the iPod® docking station 34; and on/off setting with an LED 46 for indication of functional operation of the fingerprint recognition biometric device 36.

A power supply 48 is incorporated in the electronic security container 10 and is in electrical communication with the electronic devices housed within the console 26. This power supply 48 may include a remote AC/DC power converter 50, an internal AC/DC power converter with a mains power cord 52 or one or more storage batteries 54 as shown in FIGS. 8 and 16.

An enclosure 56 is attached to the console 26, with the enclosure 56 having a top opening lid 58, and a bottom storage compartment 60 with at least one spring loaded hinge 62 attached therebetween, as depicted in the exploded view of FIG. 8. The enclosure 56 resembles a conventional clock radio with an iPod® docking station incorporated therein as it preferably has radial sides, as shown in FIGS. 1-8 or any other configuration resembling a modern up-to-date small electrical appliance suitable for being located on a desk, table, cabinet, counter top or other suitable location. While sheet steel in 20 gauge thickness is the preferred material the enclosure 56 may be made of any thickness steel, aluminum, reinforced polymer resin or other suitable materials.

Figure 2:
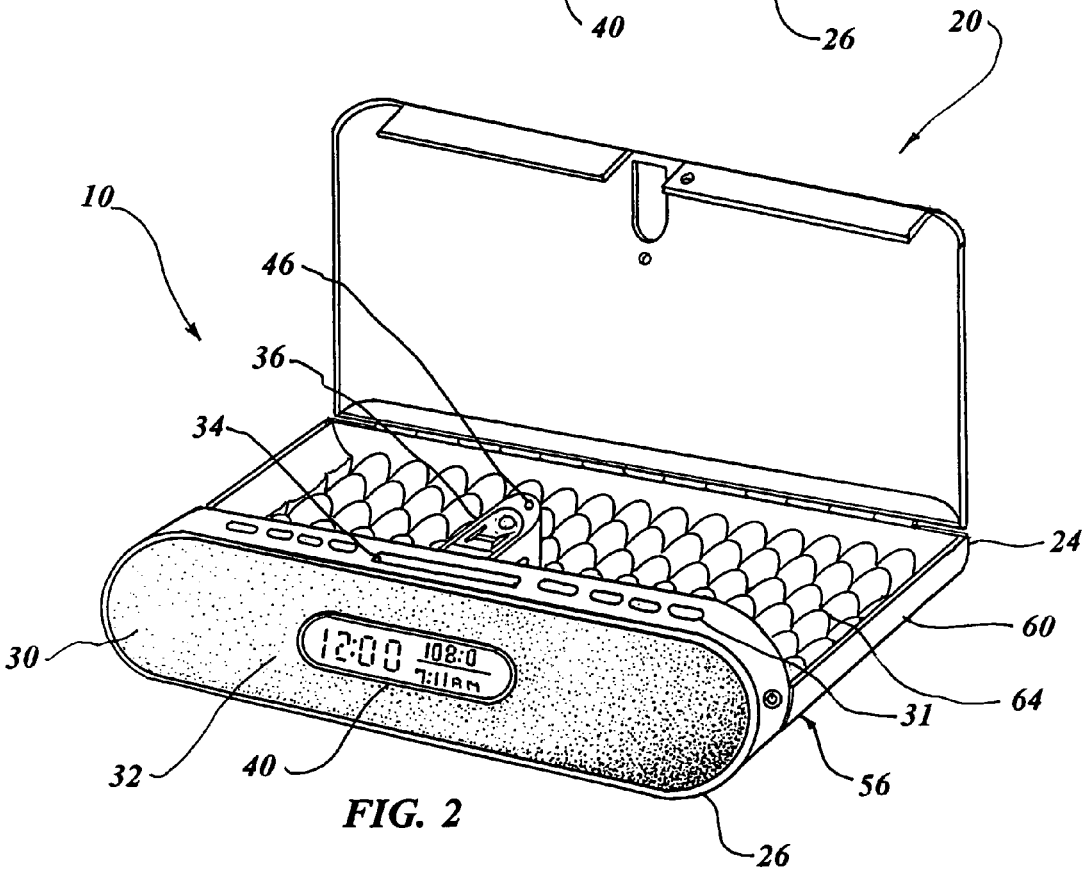
FIG. 2 is a partial isometric view of the invention with the lid hinged open in the top opening lid embodiment.
Figure 3:
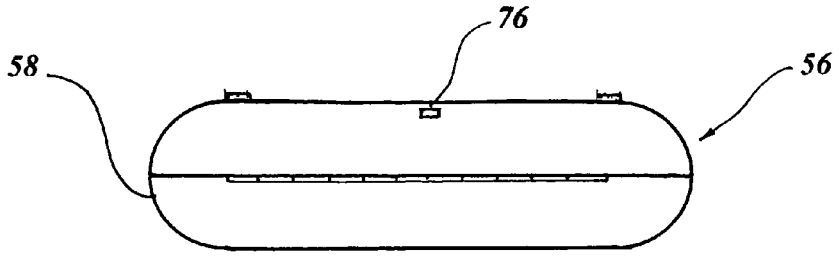
FIG. 3 is rear elevation view of the invention in the top opening lid embodiment.
Figure 4:
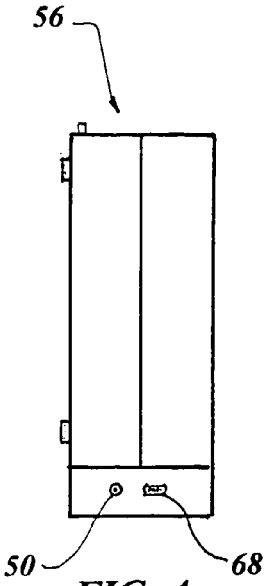
FIG. 4 is left side elevation view of the invention in the top opening lid embodiment.
Figure 5:
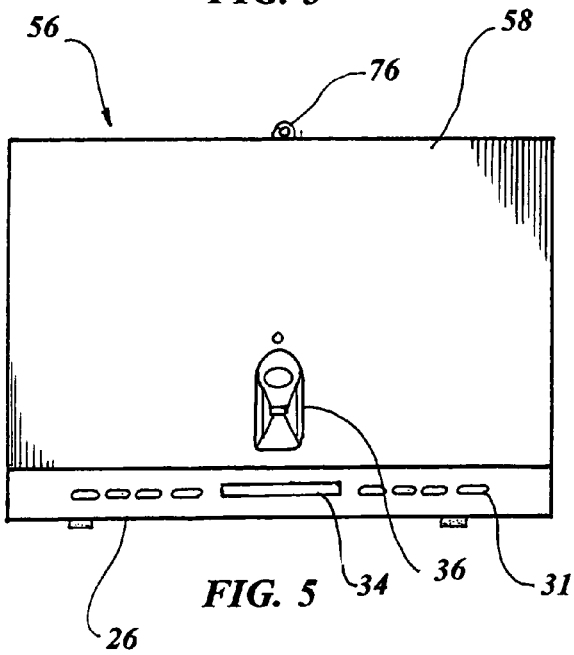
FIG. 5 is top elevation view of the invention in the top opening lid embodiment.
Figure 6:
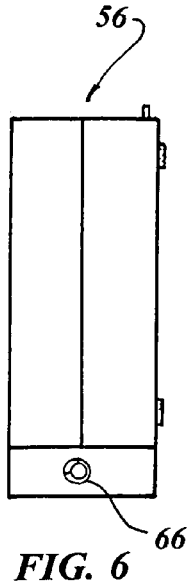
FIG. 6 is right side elevation view of the invention in the top opening lid embodiment.
Figure 7:
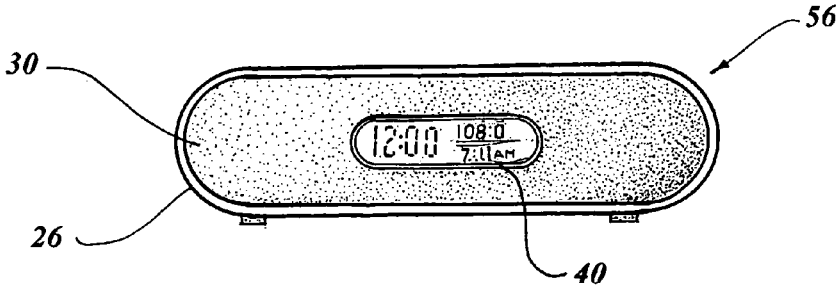
FIG. 7 is front elevation view of the invention in the top opening lid embodiment.
Figure 10:
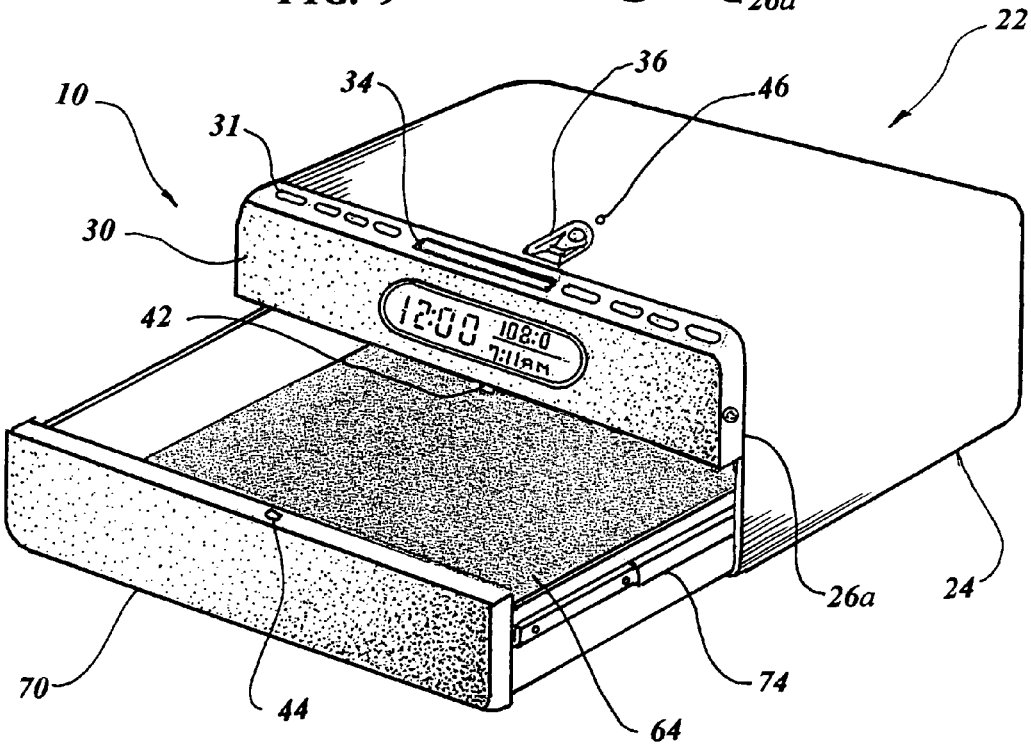
FIG. 10 is a partial isometric view of the invention with the drawer extended in the slide drawer opening lid embodiment.
Figure 11:
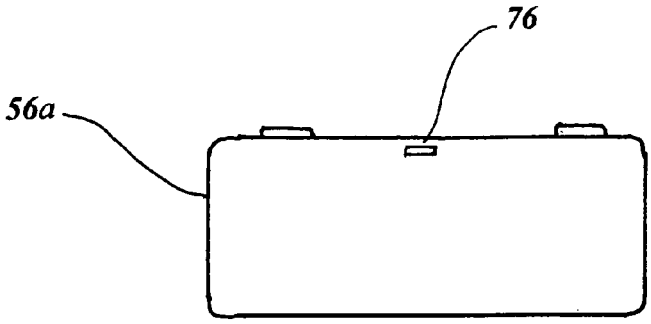
FIG. 11 is rear elevation view of the invention in the slide drawer embodiment.
Figure 12:
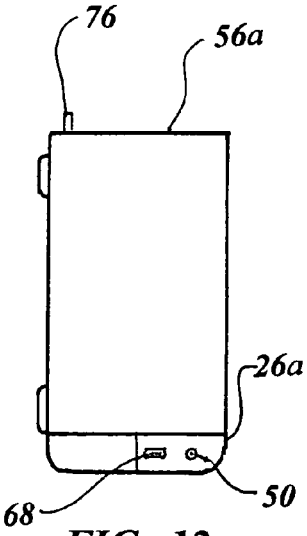
FIG. 12 is left side elevation view of the invention in the slide drawer embodiment.
Figure 13:
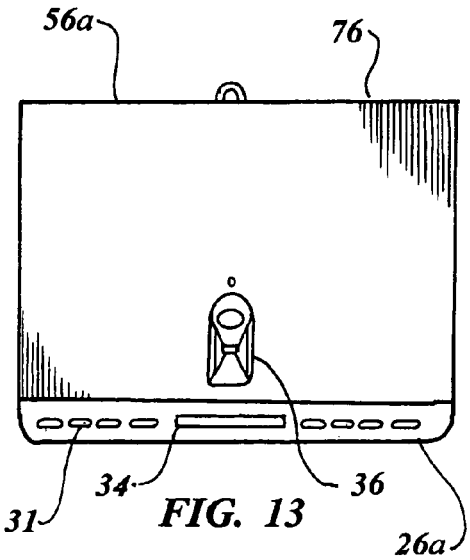
FIG. 13 is top elevation view of the invention in the slide drawer embodiment.
Figure 14:
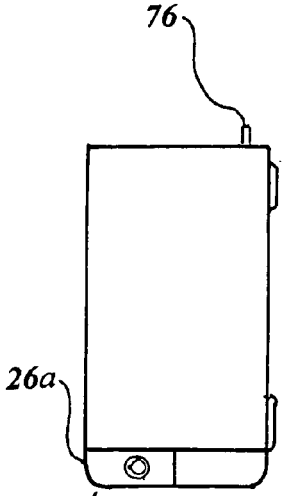
FIG. 14 is right side elevation view of the invention in the slide drawer embodiment.
Figure 15:
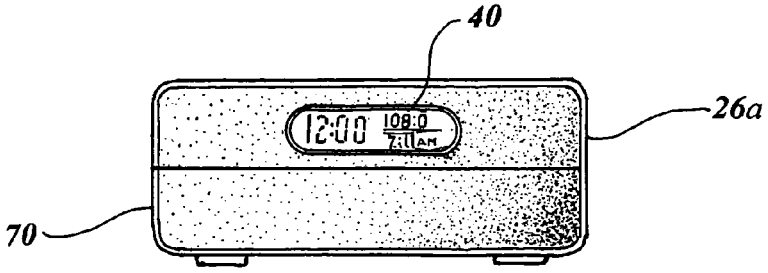
FIG. 15 is front elevation view of the invention in the slide drawer embodiment.

To provide a suitable cushion for valuables such as a handgun or jewelry the bottom storage compartment 60 preferably contains a resilient cushion 64 positioned in the bottom surface consisting of egg crate convoluted foam as illustrated in FIGS. 2 and 8, or a closed cell sponge sheet, a polyurethane foam sheet, a polyamide foam sheet, a urethane foam sheet and a felt sheet, shown in FIGS. 10 and 16.

In order to provide a second method of entry into the security container 10 bypass entry means for bypassing the fingerprint recognition biometric device 36 are provided which consist of a key lock electric bypass 66 with the lock mounted within the console 26 requiring a mating key to energize the solenoid 42 of the electrical locking mechanism 38. A USB port 68 including an electronic system may be mounted within the console 26 sending a signal from a remote programmable electronic device to energize the solenoid 42 of the electrical locking mechanism.

The slide drawer opening embodiment 22, illustrated in FIGS. 9 thorough 16 and 17 utilizes the same console 26 along with the same electronic devices and power supply as in the top opening embodiment 20 described above. The only difference is in the configuration of the enclosure 56*a* and the shape of the console 26*a* to mate with the enclosure. It is further anticipated that the same electronic devices and power supply may be incorporated into the enclosure itself without a separate console and still be within the scope of the invention herein disclosed.

Since all of the elements of electronic devices and power supply have been previously presented in specific detail in the top opening embodiment 20 and are shared exactly in the slide drawer opening embodiment 22, it is not deemed necessary to repeat the description and the item designations utilize the same numeric identification in FIGS. 9 thorough 16 as illustrated in FIGS. 1 through 8.

The enclosure 56*a* of the slide drawer opening embodiment 22 has the console 26*a* secured within its upper portion and incorporates a sliding drawer 70 housed within its lower portion. The enclosure 56*a* is made of the same material as described above and may be a single sheet of material formed into an open ended box and overlapped or butted together with reinforcements, formed in multiple pieces or cast as a complete unit of resin. It is preferred that at least the enclosure 65*a* top longitudinal edges are radiused or at least have some decorative shape or distinctive feature.

The drawer 70, illustrated best in FIG. 16, is preferably rectangular in shape, made of the same material as the enclosure 56*a* and has a front edge duplicating the front of the console 26*a* giving the impression of simply a division of the acoustic covering 30*a*, since both are made of the same material and construction as previously described.

The resilient cushion 64 is disposed in a bottom surface of the sliding drawer 70 and consists of a egg crate convoluted foam, a closed cell sponge sheet, a polyurethane foam sheet, a polyamide foam sheet, a urethane foam sheet or a felt sheet with the sheet material illustrated in FIGS. 10 and 16.

The console 26*a* is secured within an upper portion of the enclosure 56*a* with attachment means in the form of U-shaped rails 72 or the like which grip the console sides and are secured with threaded fasteners. Alternatively attachment means may be exclusively using any threaded fastener, rivets, sheet metal screws or the like without the necessity of using the rails 72.

Attachment of the sliding drawer 70 to the enclosure 56*a* may be accomplished using at least two spring loaded drawer slides 74 attached to the bottom portion of the enclosure 56*a*. The slides 74 permit the drawer 70 to glide outwardly under spring influence when the drawer 70 has been released with the electrical locking mechanism 38 thereby gaining access into the security container 10. Bypass entry means are identical to those utilized for the top opening lid embodiment 20.

For both embodiments 20 and 22 an optional factory installed accessory may be a device for securing the container 10 to a solid object such as a wire rope with a padlock to a hasp 76 in the back of the container 10. Alternatively the container 10 may be directly connected with fasteners to the object upon which the container 10 is mounted.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An electronic device security container for storing valuable objects which comprises, a console having a plurality of electronic devices disposed inside, said electronic devices inside said console are defined as a clock radio, an iPod® docking station, an electrical locking mechanism and a fingerprint recognition biometric device outside the console, for gaining access into the security container, control means for manually regulating the electronic devices, said control means defined as:

at least time and date setting means for said clock, at least on/off setting, AM/FM setting, station selection and audio volume for said clock radio, at least on/off setting and audio volume control for said iPod® docking station, and at least on/off setting and LED indication of functional operation of said fingerprint recognition biometric device, a power supply in electrical communication with the electronic devices within the console, and an enclosure attached to the console, with the enclosure having a top opening lid, and a bottom storage container with at least one spring loaded hinge attached therebetween.

2. The electronic device security container as recited in claim 1 wherein said console further comprises a plurality of separate audio speakers facing an outside surface of the console such that sound may be emitted to the surrounding environment.

3. The electronic device security container as recited in claim 2 wherein said console further comprises a speaker acoustic covering disposed in front of the speakers with the covering selected from the group consisting of woven material, perforated metal, perforated thermoplastic resin, wire cloth, wire fabric, synthetic screening fiberglass cloth and flannel cloth.

4. The electronic device security container as recited in claim 1 wherein said electronic devices further comprises, said clock radio having a digital clock time display and an AM/FM radio with a built in antenna, said iPod® docking station is self contained and includes a cradle, a USB port, a firewire port and a stereo jack, said fingerprint recognition biometric device is configured to create a digital image of a fingerprint pattern with a biometric template which matches a users template stored therein, and said electrical locking mechanism for gaining access into the security container is an electrical solenoid attached mechanically to a latch in the lid.

5. The electronic device security container as recited in claim 1 wherein said power supply is selected from the group consisting of a remote AC/DC power converter, an internal AC/DC power converter with a mains power cord and at least one storage battery.

6. The electronic device security container as recited in claim 1 wherein said enclosure further comprises a material selected from the group consisting of steel, aluminum and reinforced polymer resin.

7. The electronic device security container as recited in claim 1 further comprising a resilient cushion disposed in a bottom surface of the enclosure selected from the group consisting of a egg crate convoluted foam, a closed cell sponge sheet, a polyurethane foam sheet, a polymide foam sheet, a urethane foam sheet and a felt sheet.

8. The electronic device security container as recited in claim 1 further comprising bypass entry means for bypassing the fingerprint recognition biometric device, said bypass entry means selected from the group consisting of a key lock electric bypass with the lock mounted within the console requiring a mating key to energize the electrical locking mechanism for gaining access into the security container and, a USB port with an programmable electronic system mounted within the console for sending a signal from a remote electronic device to energize the electrical locking mechanism to gain access into the security container.

9. An electronic device security container for storing valuable objects which comprises, a console having a plurality of electronic devices disposed inside, said electronic devices inside said console are defined as a clock radio, an iPod® docking station, an electrical locking mechanism and a fingerprint recognition biometric device outside the console, for gaining access into the security container, a power supply in electrical communication with the electronic devices within the console, an enclosure having the console secured within an upper portion and said enclosure having a sliding drawer housed within a lower portion, and control means for manually regulating electronic devices, said control means defined as:

at least time and date setting means for said clock, at least on/off setting, AM/FM setting, station selection and audio volume for said clock radio, at least on/off setting and audio volume control for said iPod® docking station, and at least on/off setting and LED indication of functional operation of said fingerprint recognition biometric device.

10. The electronic device security container as recited in claim 9 wherein said console further comprises a plurality of separate audio speakers facing an outside surface of the console such that sound may be emitted to the surrounding environment.

11. The electronic device security container as recited in claim 10 wherein said console further comprises a speaker acoustic covering disposed in front of the speakers with the covering selected from the group consisting of woven material, perforated metal, perforated thermoplastic resin, wire cloth, wire fabric, synthetic screening fiberglass cloth and flannel cloth.

12. The electronic device security container as recited in claim 9 wherein said electronic devices further comprises, said clock radio having a digital clock time display and an AM/FM radio with a built in antenna, said iPod® docking station is self contained and includes a cradle, a USB port, a firewire port and a stereo jack, said fingerprint recognition biometric device is configured to create a digital image of a fingerprint pattern with a biometric template which matches a users template stored therein, and said electrical locking mechanism for gaining access into the security container is an electrical solenoid attached mechanically to a latch on the sliding drawer.

13. The electronic device security container as recited in claim 9 wherein said power supply is selected from the group consisting of a remote AC/DC power converter, an internal AC/DC power converter with a mains power cord and at least one storage battery.

14. The electronic device security container as recited in claim 9 wherein said enclosure and said sliding drawer further comprises a material selected from the group consisting of steel, aluminum and reinforced polymer resin.

15. The electronic device security container as recited in claim 9 further comprising a resilient cushion disposed in a bottom surface of the sliding drawer selected from the group consisting of a egg crate convoluted foam, a closed cell sponge sheet, a polyurethane foam sheet, a polymide foam sheet, a urethane foam sheet and a felt sheet.

16. The electronic device security container as recited in claim 9 wherein said console secured within an upper portion of said enclosure further comprises attachment means selected from the group consisting of U-shaped rails, threaded fasteners, rivets and sheet metal screws, and wherein said sliding drawer housed within said enclosure is attached to said enclosure with a plurality of spring loaded drawer slides permitting the drawer to slide outwardly under spring influence when the drawer has been released with said electrical locking mechanism for gaining access into the security container.

17. The electronic device security container as recited in claim 9 further comprising bypass entry means for bypassing the fingerprint recognition biometric device, said bypass entry means selected from the group consisting of a key lock electric bypass with the lock mounted within the console requiring a mating key to energize the electrical locking mechanism for gaining access into the security container and, a USB port with an electronic system mounted within the console for sending a signal from a remote programmable electronic device to energize the electrical locking mechanism to gain access into the security container.

* * * * *